US005315808A

United States Patent [19]

MacIvor et al.

[11] Patent Number: 5,315,808

[45] Date of Patent: * May 31, 1994

[54] FORMING STRETCH STRAPPING AND BINDING AN ARTICLE THEREWITH

[76] Inventors: Michael MacIvor, Miami, Fla.; Celeste B. MacIvor, legal representative, 8201 SW. 188th St., Miami, Fla. 33157

[ * ] Notice: The portion of the term of this patent subsequent to Sep. 5, 2008 has been disclaimed.

[21] Appl. No.: 651,123

[22] Filed: Feb. 6, 1991

[51] Int. Cl.[5] ..... B65B 13/08

[52] U.S. Cl. ..... 53/399; 53/441; 53/556; 53/588; 53/389.4

[58] Field of Search ..... 53/399, 441, 556, 389.2, 53/389.3, 389.4, 588, 589, 141

[56] References Cited

U.S. PATENT DOCUMENTS

| | | | |
|---|---|---|---|
| 1,235,312 | 7/1917 | Hadert | 53/588 X |
| 4,235,062 | 11/1980 | Lancaster | 53/556 X |
| 4,255,918 | 3/1981 | Lancaster | 53/556 |
| 4,406,728 | 9/1983 | Ohba | 53/588 X |
| 4,807,728 | 2/1989 | Casteel | 53/556 |

*Primary Examiner*—John Sipos
*Attorney, Agent, or Firm*—James Wetterling

[57] ABSTRACT

This invention relates to both an apparatus and method of forming a thin flexible and to some extent resilient material strap from a supply of sheet film and further wherein the apparatus and method involves the positioning of the formed stretchable strapping about and in binding relation to the exterior of any one of a plurality of various types of packages, articles, etc. The apparatus comprises positioning means which serves to grip a free end of the formed stretch strapping and exert a pulling force thereon to direct it about a predetermined path of travel surrounding the article being bound and subsequently securing a length of the stretch strapping in binding engagement with the exterior surfaces or portions of the article being bound.

20 Claims, 4 Drawing Sheets

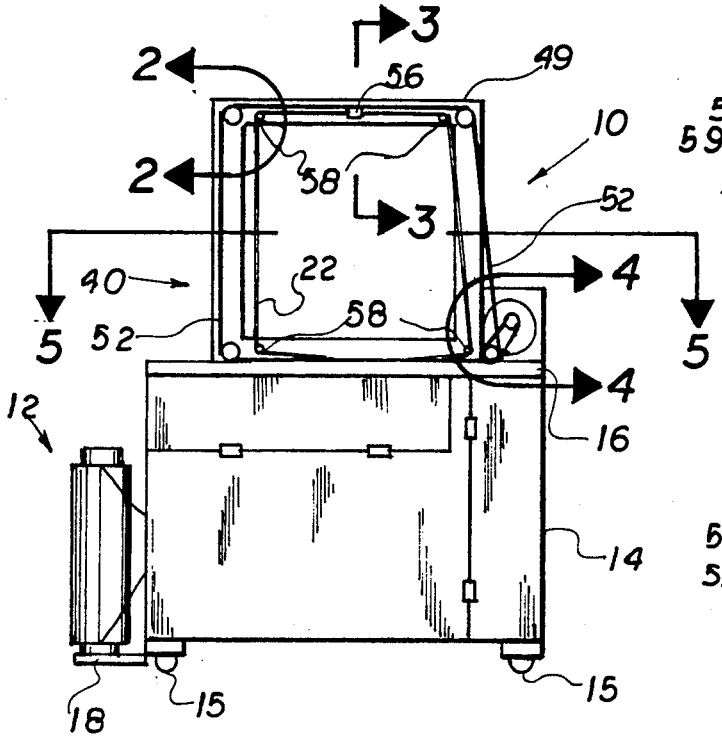
FIG 1
FIG 2
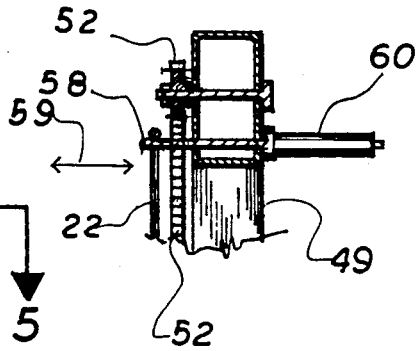
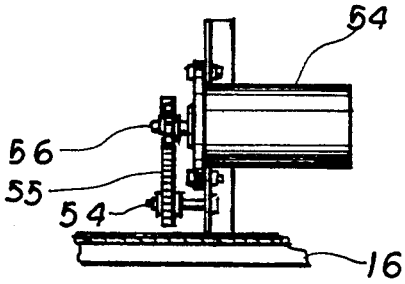
FIG 4
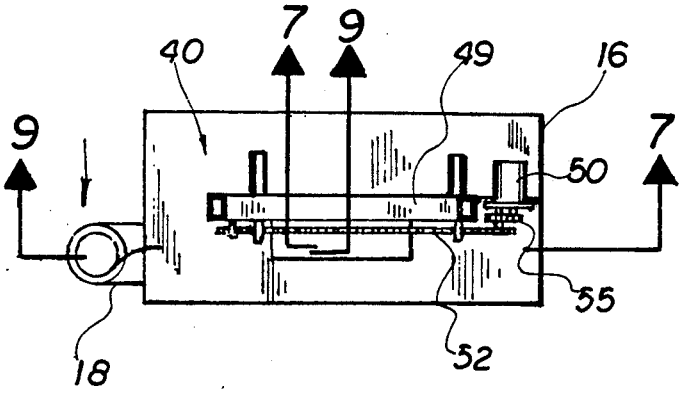
FIG 5
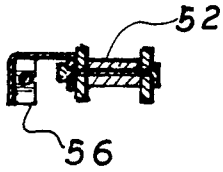
FIG 3

FIG 7
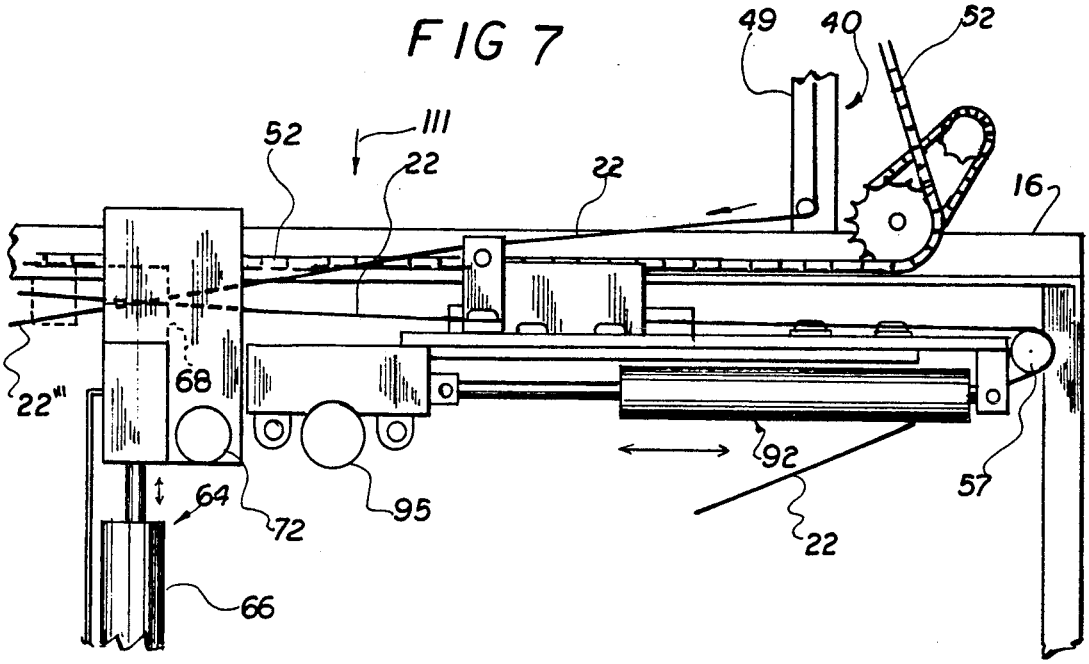
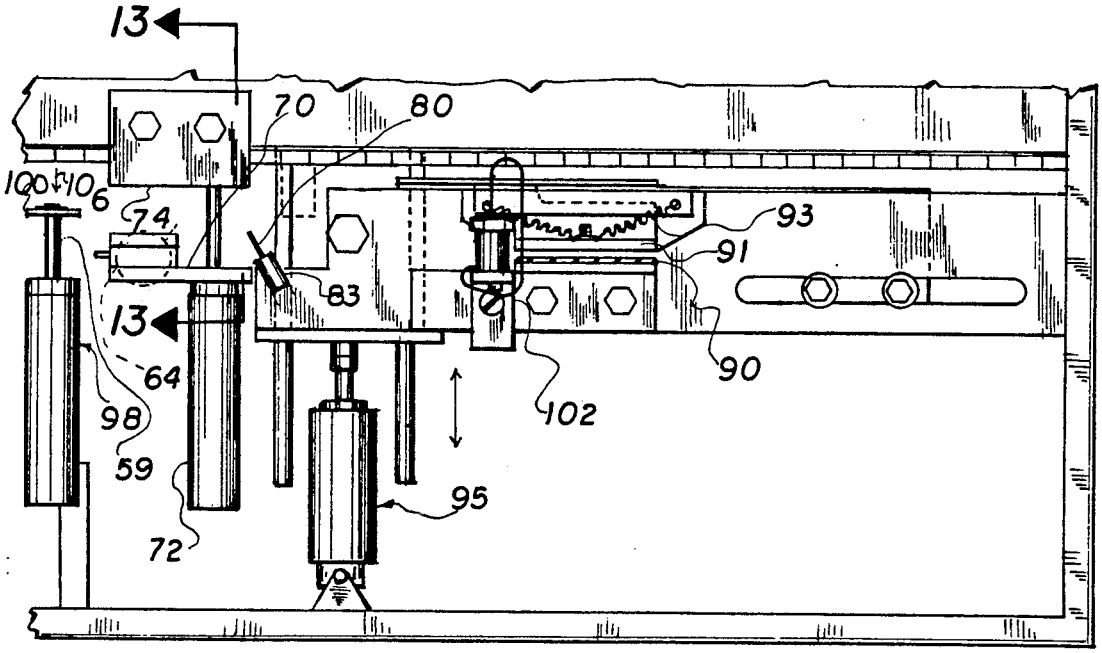
FIG 6

FORMING STRETCH STRAPPING AND BINDING AN ARTICLE THEREWITH

BACKGROUND OF THE INVENTION

1. Field of the Invention

This invention relates both to an apparatus and method for forming a stretchable strap from a supply of stretchable film material initially having a sheet configuration and once formed to positioning the stretchable strap into securing engagement with an article, package, etc. being bound.

2. Description of the Prior Art

The prior art is replete with "strapping machines" specifically designed to bind an article, package, etc. with a strap formed of a plurality of materials most of which are commonly distinguished by being non-elastic or non-stretchable. While the material from which the prior art strapping is formed is naturally capable of a certain amount of flexibility, required to position the strap about the article being bound, none of the prior art strapping material known is capable of any elastic expansion or stretching. More specifically, strapping machines normally use a variety of materials including but not limited to polypropelene, fiberglass, steel or metal and other such non-elastic material. A lack of elasticity in the prior art materials is in fact a requirement based on the design and structural operation of the prior art machines used to bind the various articles or packages utilizing such materials. More specifically, in the operation of the prior art strapping machines, the strapping is fed into the machine from a coil which has been preformed. A free end is directed into some type of directing sleeve or channel and a pushing force is exerted thereon. The free end travels the length of the directing or positioning channel and serves to effectively surround the article or package being bound. Once the non-elastic strap is at its intended position it is disposed into engaging relation with the outer surface thereof and connected to itself by a variety of means dependent on the particular prior art material utilized.

While it is of course to be assumed that the prior art strapping machines, as well as the known and commercially existing strapping materials, are operative for their intended function, it is also recognized in the industry that such non-elastic strapping is at least somewhat inefficient and also more expensive than other materials that could be utilized if in fact the technology were available.

The invention herein, to be described in greater detail hereinafter, utilizes a different, more efficient and less expensive material in the formation of a "stretchable strapping" which is still of high strength but which has certain elastic capabilities allowing it to overcome certain problems existing in the prior art and presently commercially available strapping machines and strapping material.

SUMMARY OF THE INVENTION

The present invention is directed to both an assembly or apparatus as well as a method of forming a stretchable strapping from a sheet of flexible, elastic film material and positioning a "single strand" of the formed stretchable strapping into fixed bound engagement about the exterior surfaces of any one of a plurality of packages, articles, objects, etc. This of course differs from prior art apparatus and techniques which utilize a flexible but non-elastic strapping material normally formed of a metallic, plastic, fiberglass of like prior art material. While the present invention could incorporate numerous materials having certain elastic capabilities, one preferred material now commercially available is a linear, low density, polyethylene material originally supplied to the apparatus of the present invention in a sheet configuration stored on a continuous roll. The apparatus or assembly comprises a support base or frame on which the remaining components of the apparatus are mounted in cooperative, working relation to one another. More specifically, the subject assembly includes a shaping means located in a receiving location to the rolled supply of stretchable material film in a sheet configuration. The sheet is initially guided or "threaded" through a shaping ring or like structure which effectively channels the film down from its sheet configuration into an elongated strap. A stretching means is considered part of the shaping means and is mounted on the support base or frame downstream of the shaping ring and comprises a plurality of driven pulleys or rollers.

In a preferred embodiment, to be described in greater detail hereinafter, the plurality of driven rollers includes a first roller and second roller wherein the first roller is located downstream of the second roller and both rollers serve to drivingly engage the formed, elongated strap. A stretching action occurs by structuring the first, downstream roller or pulley to have a greater peripheral rotating speed than the second or upstream roller. This will in effect provide a pulling force between the first and second rollers to a sufficient degree to effectively stretch the strap. The amount of stretch or linear increase in the overall length is dependent upon the particular, predetermined parameters of the material. Purposely, the material is not stretched to its maximum linear dimension but to a length somewhat less than the maximum longitudinal or linear dimension. This allows the formed stretchable strap to have a certain degree of elasticity remaining therein. This lends greater efficiency and security to the articles once bound by the stretchable strap or "stretch strapping" by allowing it to adapt to any shift in weight or positioning of the articles, objects or packages being bound by the stretch strapping. The formed stretch strapping is then passed along a flow path by a plurality of components including free wheeling pulleys and/or rollers until it reaches a positioning means.

The positioning means includes a gripping structure which serves to removably grasp or grip the free end of the formed stretch strapping. A drive structure preferably in the form of a closed, continuous drive chain, is connected to and drives the gripping structure with the free end of the strap attached thereto. A reversible drive motor serves to force the drive chain along a predetermined path of travel defined by its surrounding placement to an article or object to be bound. More specifically, a supporting yoke assembly having a continuous, closed configuration surrounding a central opening more fully describes the aforementioned path of travel. The object to be bound is positioned within the central aperture and the drive chain and drive motor are activated to exert a pulling force on the strap by virtue of it being gripped by the gripping structure. Once the formed stretch strapping or strap is disposed along the path of travel and in surrounding relation to the object to be bound, but outwardly spaced therefrom, it is further positioned into binding contact with the outer surface or portions of the article to be bound.

Control mechanisms serve to effectively tighten the strap about the outer surfaces to a point where certain segments of the strap are disposed in crossed-over relation to one another. A heat sealing structure is inserted at this cross-over point to heat the temperature of the material from which the strap is formed to an effective melting temperature. Such portions are pressed together to form a tight heat seal or weld and the strap is severed or otherwise disconnected, preferably by a heated wire or the like so as to segregate the length of the strap now bound to the outer portions of the article from the remainder of the strap yet to travel about the aforementioned path of travel. After removal of the article already bound, the next cycle continues after the article is placed within the aperture of the yoke assembly as described above.

An important feature of the present invention, including the method of forming and positioning the stretch strapping includes the exertion of a pulling force on the flexible and elastic material subsequent to its being formed into an elongated strap. This pulling force is exerted on the strap by gripping the free end thereof until it surrounds the article or package to be bound. The flexibility as well as the elasticity of the light but high strength material (linear low density polyethylene) on which the strap is formed prevents it from being positioned and manipulated in the conventional, prior art fashion as with known strapping machines. The increased elasticity and flexibility, even after being subjected to a stretching step, allows it to be securely bound about the outer portions of the article being bound and further allows it to adapt to any shifting or movement of the article, overcoming certain prior art problems.

Other structural components of the assembly including a tensioning means to maintain the strap in a linearly taught condition is described in greater detail hereinafter.

BRIEF DESCRIPTION OF THE DRAWINGS

For a fuller understanding of the nature of the present invention, reference should be had to the following detailed description taken in connection with the accompanying drawings in which:

FIG. 1 is a front view of the assembly of the present invention.

FIG. 2 is a sectional view along line 2—2 of FIG. 1.

FIG. 3 is a partial sectional view in detail along line 3—3 of FIG. 1.

FIG. 4 is a sectional view along line 4—4 of FIG. 1.

FIG. 5 is a top view along line 5—5 of FIG. 1.

FIG. 6 is a top view of certain components of the assembly to be described in greater detail.

FIG. 7 is a front view of the structure of FIG. 6.

Like reference numerals refer to like parts throughout the several views of the drawings.

DETAILED DESCRIPTION OF THE PREFERRED EMBODIMENT

As shown in the accompanying figures, the present invention is directed towards an assembly generally indicated as 10 for forming a stretchable strap having an elongated configuration from a supply of film having a sheet configuration and rotatably mounted on the assembly 10 in a roll form as generally indicated as 12. As will be explained in greater detail hereinafter, the material from which the stretchable strapping is formed is an elastic material and is preferably a linear, low density polyethylene material. It should be emphasized, however, that other materials can in fact be used as long as their elastic and strength characteristics are applicable for the intended use herewith.

The assembly comprises a support base having an outer housing or frame which serves to support the remainder of the components to be described hereinafter. The base or housing 14 may be permanently or more preferably movably mounted by casters or wheels 15 secured thereto.

Figure 9:
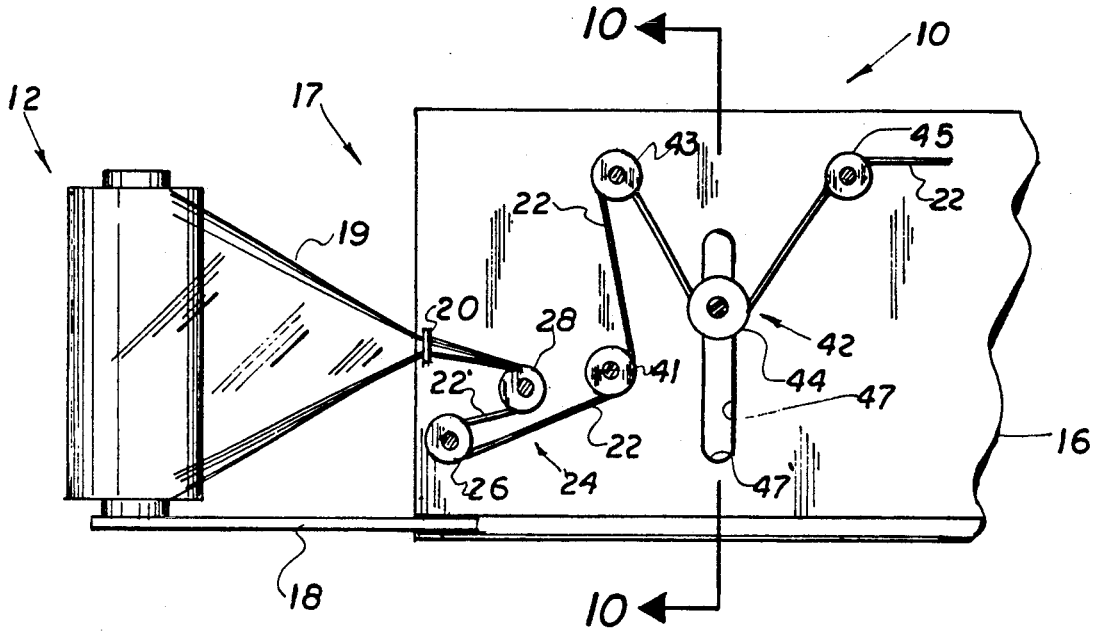
FIG. 9 is a front view in partial cut-away of the supply of film in a sheet configuration utilized in the assembly and method of the present invention.
Figure 11:
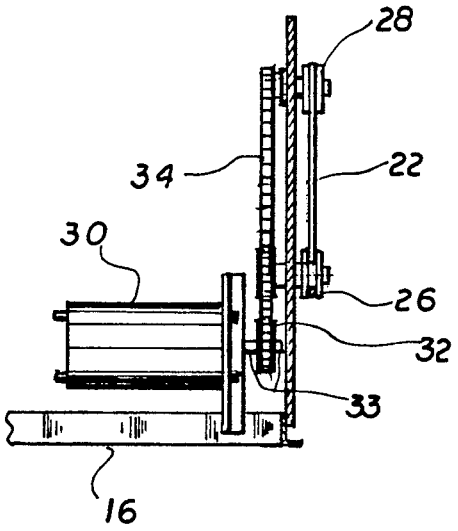
FIG. 11 is a sectional view of certain components associated with the embodiment of FIG. 9.

With reference to FIG. 9, the assembly 10, with the housing 14 removed, includes a support base as at 16 wherein the supply roll of stretchable film as at 12 is rotatably mounted by a supporting arm 18 at what may be referred to as an input or leading portion generally indicated as 17 of the assembly 10. A shaping means 20 may take the form of a ring, channel, sleeve, etc. or other like structure which serves to shape the film as at 19 from its sheet-like configuration, substantially convergently downwardly into an elongated strip hereinafter referred to as the strap or formed strap 22. The material is pulled through the shaping ring 20 by the stretching means which is generally indicated in FIG. 9 as 24. The stretching means may be considered part of the shaping means and includes a first drive roller 26 and a second driven roller 28 both driven by a drive motor 30 as best shown in FIG. 11. The drive motor 30 serves to forcibly rotate the drive gear as at 32 by means of a drive shaft 33 attached thereto. An elongated drive chain as at 34 serves to interconnect both the first roller or pulley 26 and the second roller or pulley 28 in a manner which causes the forced rotation of both. The first roller is specifically dimensioned, configured and otherwise structurally adapted to rotate at a greater peripheral speed than the second roller 28. This serves to exert a pulling and stretching force on the segment of the strap as at 22' causing it to stretch and thereby be elongated to a length somewhat less than its maximum degree of stretch or longitudinal extension depending upon the particular tension parameters of the material used. In other words, the strap 22 is stretched as at 22' to a degree somewhat less than its maximum stretchable limits so that a certain amount of elasticity or "memory" remains within the strap 22 as it is bound around an object, article, container, etc. generally indicated as 39 in FIG. 12, also to be explained in greater detail hereinafter.

Figure 12:
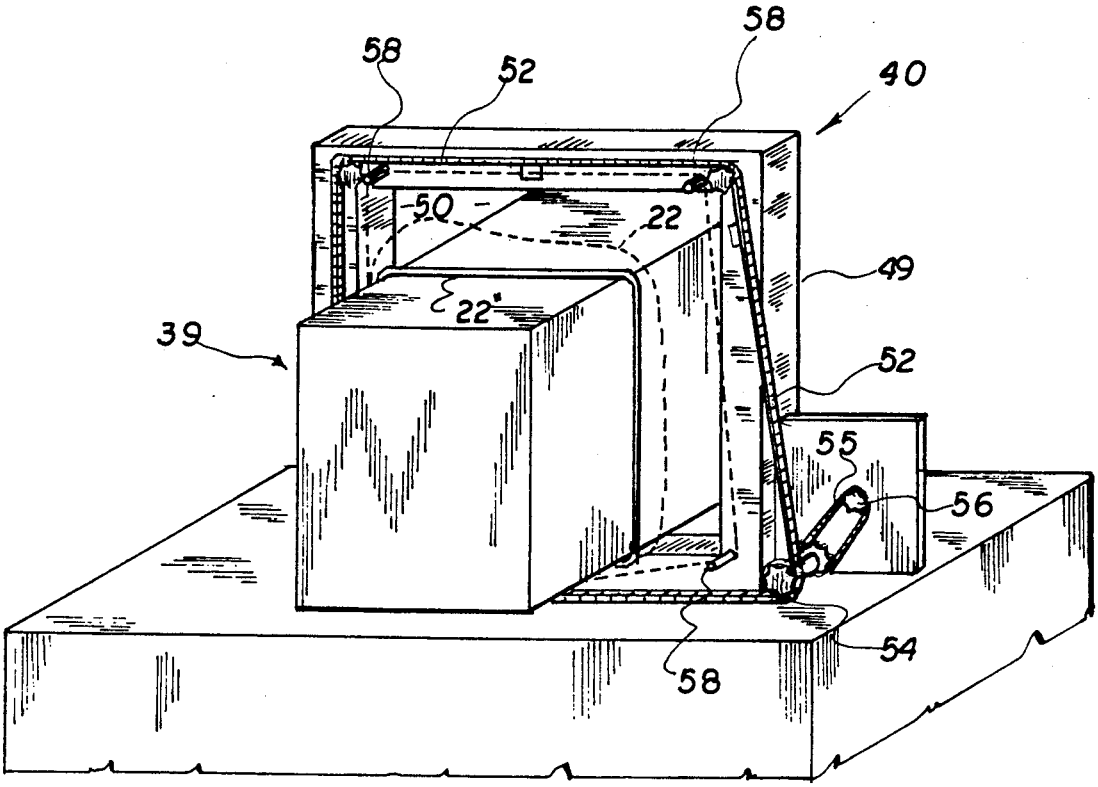
FIG. 12 is a perspective view of a yoke assembly of the apparatus of the present invention.
Figure 8:
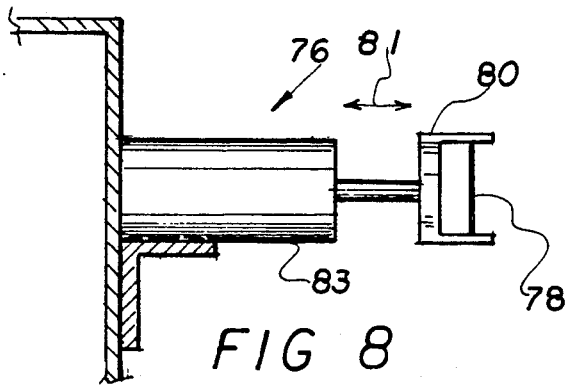
FIG. 8 is a detailed sectional view in partial cut-away of a moving structure associated with the assembly of the present invention.

Further with regard to FIG. 9, the strap 22, after leaving the stretching means generally indicated as 24, travels around a predetermined path of travel at least partially defined by spaced apart free wheeling pulleys or rollers as at 41, 43 and 45. This path of travel leads and guides the strap 22 to the yoke assembly generally indicated as 40 and as best shown in FIGS. 1 and 12. In addition, a tensioning means generally indicated as 42 is mounted on the support base 16 downstream of the stretching means 24 but prior to the strap 22 reaching the yoke assembly 40.

Figure 10:
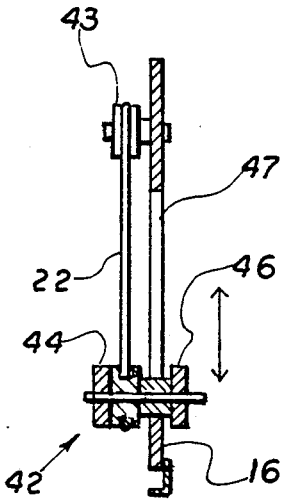
FIG. 10 is a sectional view along line 10—10 of FIG. 9.

The tensioning means 42 comprises a roller or pulley member 44 which, as best shown in FIG. 10, is attached to a weight or like member as at 46 which is adapted to move reciprocally in a substantially vertical orientation, under the influence of gravity, within an elongated guide slot or channel as at 47. The tensioning means 42 includes the member 46 which may in effect define a weight influenced by gravity to be normally biased downwardly towards the lower end as at 47' of the guide slot 47. This will have the effect of always placing an adequate amount of tension on the strap 22 thereby maintaining it in a substantially taut condition. The weighted tension structure 42, 46 due to its constant and continuous engagement with the strap 22 will also serve to force the strap from a predetermined path of travel about the length of the yoke assembly 40 into confronting engagement with the article 39 being bound. Such confronting engagement is indicated in FIG. 12 as 22".

The flow path as generally described and defined with reference to the structure of FIG. 9 should be more clearly defined as the travel of the strap 22 as it is formed from a sheet configuration from the stretchable film 19 into an elongated strap as shown. The flow path is generally defined as the path of travel along which the strap is forced prior to its entering the yoke assembly 40. The yoke assembly includes various components including a substantially continuous, closed frame 49. The frame is further defined by a central receiving opening as at 50 through which the article 39 at least partially passes and is positioned in order to receive the binding strap 22 into binding engagement with outer surface portions thereof as indicated by the strap in FIG. 12 as 22".

The yoke and its closed, continuous configuration of its frame 49 defines a path of travel of the strap as it is forced by being pulled, effectively along the length of the yoke 49, by the positioning means. The positioning means comprises an elongated continuous drive member preferably in the form of a drive chain as at 52. A drive gear as at 54 serves to forcibly drive the chain or drive member 52 continuously about the aforementioned path of travel. As shown in FIG. 4, a drive motor 54 is interconnected to the drive chain or drive member 52 by a linkage assembly including drive shaft and associated gear 56. The drive gear 54 is of course driven thereby through an additional elongated supplementary or original drive member as at 55 also in the form of a drive chain. As should be apparent, continuous operation of the drive motor 54 will cause the elongated drive member or chain 52 to rotate preferably in a clockwise direction. However, the drive motor 54 is reversible so as to at least partially reverse the direction of travel of the drive chain 52 for purposes of beginning a new cycle after an original or first article 39 has been bound as shown in FIG. 12 and is removed from the receiving opening 50 within the frame 49 of the yoke assembly 40.

An additional structure associated with the positioning means is a gripping member or structure 56 secured to the elongated drive member and movable therewith. The gripping structure 56 is specifically structurally adapted to removably grip the strap 22 as it enters into the area of the yoke assembly (see FIG. 7) from a guide roller or pulley 57 which effectively ends the aforementioned flow path as pictured and described with reference to FIG. 9. Once the strap 22 passes about the free wheeling guide roller or pulley 57, it enters into removable gripping engagement with the elongated drive member 52 of the positioning means by virtue of its removable connection to the gripping structure 56 as shown in detail in FIG. 3. The activation of the drive motor 54 causes the elongated drive member 52 to be pulled or travel in a clockwise direction about the yoke assembly 40 and accordingly, pull and engage a free end of the strap 22 therewith by virtue of its connection with the gripping structure 56. Continued driving and activation of the drive motor 54 will cause the continued travel of the drive member 52 in a clockwise direction and a continuous pulling force being exerted on the strap 22 as it travels along the path of travel generally defined by the configuration of the yoke frame 49. The gripping structure 56 is adapted to maintain a gripping force on the free end of strap 22 as long as the drive chain travels in the preferred clock-wise direction. However, travel in the opposite direction serves to automatically release the strap from the gripping structure 56.

As part of this path of travel, a retaining means is provided so as to retain the strap 22 along the length of the path of travel and generally about the periphery of the receiving opening 50. More specifically, the retaining means comprises a plurality of outwardly extending retaining fingers 58 disposed in spaced apart relation to one another. The fingers 58 are reciprocal as indicated by directional arrow 59 in FIG. 2 so that the fingers may be selectively and automatically positioned into an outwardly extended operative position as shown in FIG. 2 or a retracted position by virtue of the automatic operation of fluid (air or hydraulic) operated cylinders as at 60. More specifically, the strap 22 is pulled about the path of travel and engages each of the fingers 58. These fingers, when all in their outwardly extending operative position (FIG. 2) serve to retain the strap 22 in an outward spaced location and in surrounding relation to the article 39 to be bound. Once the fingers are all concurrently retracted into their non-operative position, the strap 22 is directed inwardly into its bound position in engagement with the outer surface of the article 39 as represented in FIG. 12 as 22". The inward gathering of the strap 22 into the position 22" is provided or aided at least in part due to the existence of the tensioning means 42 which exerts a weight, due to gravity, as provided by the weighted roller 46, 44 on the strap 22 (see FIGS. 9 and 10). As the retaining fingers 58 are moved to their retracted, non-supporting position, the pulley and weight 44, 46 fall to the bottom of the elongated slot 47 as at 47'. This takes up the slack of the strap 22 and will allow it to be tightly bound about the outer surface of the article 39 into the bound position 22".

Figure 13:
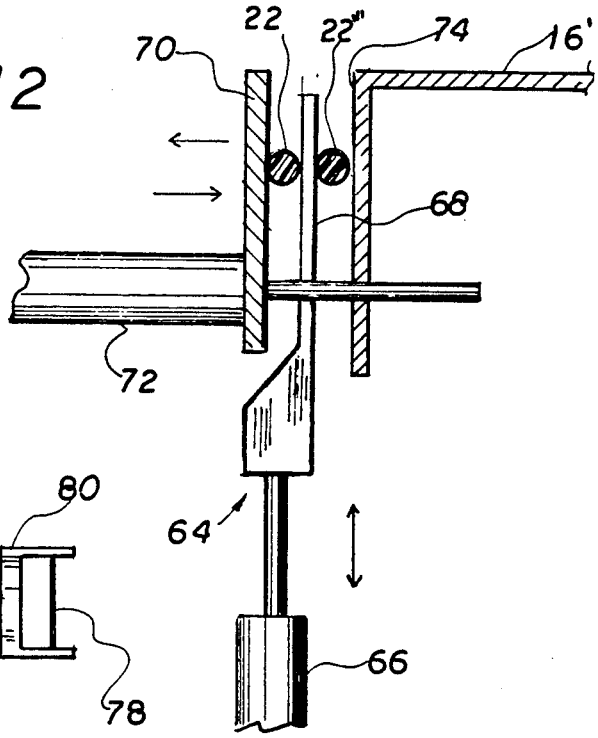
FIG. 13 is a sectional view in partial cut-away of the sealing structure associated with the assembly of the present invention.

With reference to FIGS. 6 and 7, an additional control mechanism is provided and shown in detail in FIGS. 6 and 7. Such control mechanism and weighted movements of the components to be described in detail hereinafter are moved automatically by a plurality of micro switches, sensors, relays, etc. the details of which are well known in the art and commercially available. FIG. 7 shows that the end of the strap as at 22''' has made a complete travel about the path of travel generally defined by the length of the yoke frame 49. It is brought by the gripping member 56 into a cross-over point wherein the strap 22 and 22''' essentially overlap as best shown in FIG. 13. At the point of cross-over, a heating element generally indicated as 68 moves upwardly through the operation of a fluid-activated piston and cylinder arrangement 66 to a point where the heating element or plate 68 comes between the two segments of the strap 22 and 22''' and into engagement with both for the purpose of heating. Before the heating plate 68 is retracted, the two segments 22 and 22' are forced together by a press plate as at 70 also activated by appropriate fluid piston and cylinder arrangement 72. The press plate forces the two strands 22 and 22''' into engagement with one another and against the heating plate 68 due to the existence of a brace plate 74 which may be considered a part of the support base and/or frame 16. After the two strands 22 and 22''' are forced against the heating plate as described above, the heating plate 68 and the press plate 70 both retract. Once the heating plate 68 is removed from between the two strands 22 and 22''', the press plate is again forced into contact with the now heated strands 22 and 22''' forcing them together into a heat seal or weld. This binds the strap about the outer surface of the article 39 as intended.

This occurs by a spaced apart gripping plate 90 and 91 between which a segment of the strap 22 passes exerting a pulling force on the strap 22 in a direction indicated by arrow 89 in FIG. 7. Activation of the piston and cylinder arrangement generally indicated as 92 serves to reverse the direction of the plates 90 and 91 or more specifically pull back a segment of the strap 22 at a point before the overlapping heat seal engagement as pictured in FIG. 13. This will tighten the strap 22'' when in its bound position as shown in FIG. 12. Other features associated with the gripping plates 90 and 91 include a biasing spring as at 93 serving to normally bias the plate 91 away from the plate 90. The forced activation of the piston and cylinder arrangement generally indicated as 95 in FIG. 6, causes an inwardly directed travel of the plate 90 into further engagement with the plate 91 except for the fact that a strap segment is sandwiched therebetween. This all occurs immediately prior to establishing the heat weld between the overlapping strands 22 and 22'''.

Once the heat weld has been formed as described above, the strap is removed from the gripping structure 56 through activation, at least in part, of a retaining flange 100. This occurs by an additional fluid activated piston and cylinder arrangement 98 serving to drive the rod 99 and the attached retaining flange 100 in a reciprocal fashion as shown. When the retaining flange is retracted in accordance with directional arrow 106 in FIG. 6, it serves to grip the strand and pull laterally in the same direction as arrow 106.

Once the retaining flange 100 travels in the direction of the arrow 106 in FIG. 6, the drive motor 54, serving to rotate the drive chain 52 in a normally clockwise direction is reversed. This causes the reverse travel of the drive chain 52 in a counter-clockwise direction causing the gripping structure 56 attached thereto to also travel in a counter-clockwise direction. The gripping structure thereby automatically disengages the strand 22 and travels in the aforementioned counter-clockwise direction until it re-engages an aligned portion of the strand 22 at a location downstream of the now established heat weld, wherein such location is generally indicated by the indicator arrow 111 in FIG. 7. The reverse activation of the drive motor 54 continues until the gripping structure 52 again re-engages the strap 22 where indicated. Once the strap 22 is so engaged, the motor 54 is again activated so as to force the continuous rotation and travel of the drive chain 52, the gripping structure 56 and the strap 22 in a clockwise direction by exerting a pulling force on the re-engaged strap 22.

However, the now bound strap is severed by a severing mechanism at a location downstream of the heat weld after the gripping structure 56 re-engages a new portion of the aligned strand 22.

A severing mechanism generally indicated as 76 in FIGS. 6 and 7 is engaged and activated. This severing mechanism includes a heated severing wire 78 mounted on a support 80 and activated into and outwardly severing position as indicated by the directional arrow 81. Such activation and movement occurs automatically through the tripping of a relay or micro switch which in turn activates the fluid activated piston and cylinder assembly 83. The severing of the strap occurs as the last act immediately prior to starting a recycle and a repositioning of the strap 22 about the aforementioned yoke frame 48 and along the designated path of travel as set forth above.

Other features associated with the control mechanism shown in FIGS. 6 and 7 is a guide wire indicated as one of two through which one free end of the strap 22 is originally threaded. The overall configuration and dimension of the guide wire 102 is such as to maintain the strap in a given area so that it can be acted upon by the components as set forth in FIGS. 6 and 7 and as described above.

Now that the invention has been described, what is claimed is:

1. An assembly for forming a stretchable strapping and binding an article therewith, said assembly comprising:

a. a support base including a supply of sheet film material from which the strapping is formed being movably mounted on said support base, b. shaping means mounted on said base in spaced, communicating relation to said supply and structured for continuously shaping and reducing the width of the material from a sheet configuration to an elongated strap configuration, c. stretching means mounted on said base in spaced, downstream relation to said shaping means along a flow path traveled by the strap and structured for stretching the strap by applying a force thereto, d. positioning means movably mounted on said base downstream of said shaping means and removably gripping said elongated strap and being structured for exerting a pulling force thereon for positioning said strap along a predetermined path of travel relative to the article being bound, e. said path of travel defined in substantially surrounding relation to the article being bound, and f. seal means mounted on said base and disposed and structured to connect, by heat seal, overlapping ends of said strap to define a closed, continuous configuration of said strap in surrounding, binding relation to the article.

2. An assembly as in claim 1 further comprising a yoke assembly disposed to define said path of travel and configured to substantially surround the article being bound, said yoke assembly further comprising retaining means structurally adapted for positioning said strap along said path of travel in outwardly spaced relation to the article being bound.

3. An assembly as in claim 2 wherein said yoke assembly comprises a closed frame surrounding a receiving opening dimensioned and configured to receive the article therein.

4. An assembly as in claim 3 wherein said retaining means is disposed to removably position said strap substantially along the length of said frame and about a periphery of said receiving opening.

5. An assembly as in claim 4 wherein said retaining means comprises a plurality of retractable fingers disposed along the length of said frame and said path of travel and positionable between an outwardly extending, operative position and a retracted, inoperative position.

6. An assembly as in claim 5 wherein said operative position is defined by supporting engagement of said strap at a plurality of spaced apart locations along the length thereof and in spaced location of said strap from the article being bound.

7. An assembly as in claim 6 wherein said inoperative position is defined by disposition of said fingers out of supporting engagement with said strap and disposition of said strap inwardly from said frame to surrounding engagement with the article being bound.

8. An assembly as in claim 2 wherein said positioning means comprises a gripping structure removably gripping a free end of the strap and an elongated drive member movably mounted on said yoke assembly and having a continuous, closed configuration and secured to said gripping structure so as to travel therewith along the length of said yoke and said path of travel.

9. An assembly as in claim 8 wherein said positioning means further comprises a drive assembly structured to force said drive member along said path of travel and including a reversible drive motor and drive gear attached thereto and rotatable in opposite directions.

10. An assembly as in claim 9 wherein said drive gear is disposed in driving engagement with said drive member and structurally adapted with said positioning means to exert a continuous pulling force on said strap and force it along said path of travel.

11. An assembly as in claim 1 further comprising severing means mounted on said base in engaging relation to said strap in spaced relation to said seal means and a heat seal of said strap when bound on the article.

12. An assembly as in claim 1 further comprising tensioning means movably mounted on said base in movable engagement with the strap and structurally adapted for maintaining sufficient tension on the strap to keep it substantially taught and force it into engagement with the article being bound.

13. An assembly as in claim 12 wherein said tension means comprises a weight assembly movably mounted in engaging relation, weight-bearing relation to the strap as it moves along said path of travel and disposed on said base between said stretching means and said positioning means.

14. An assembly as in claim 1 wherein said stretching means comprises a first roller and a second roller both positively driven to rotate on said base in a common direction and movably disposed in driving engagement with the strap, said first roller mounted down-string of said second roller and being structurally adapted to rotate at a greater peripheral speed, whereby a pulling, stretching force is exerted on the strap between said first and second rollers.

15. A method of forming a stretchable strapping and binding an article therewith, said method comprising the steps of:

a. supplying a continuous length of stretchable material film in a sheet configuration,
b. shaping and reducing the width of the material from a sheet configuration into an elongated continuous length of strap,
c. stretching the strap subsequent to shaping continuously along a segment of a flow path traveled by the strap,
d. gripping a free end of the strap at a location downstream of the stretching thereof along the flow path and extending a pulling force thereon,
e. positioning the strap along a predetermined path of travel defined by a substantially surrounding relation to the article being bound by exertion of the pulling force thereof,
f. binding a single strand of the strap into surrounding engagement with an exterior surface of the article subsequent to positioning the strap along substantially the entire length of the path of travel,
g. connecting a leading length of the strap onto itself to define a substantially continuous, closed configuration, and into binding engagement with the article being bound, and
h. separating a remainder of the strap from the leading length bound to the article.

16. A method as in claim 15 further comprising continuously tensioning the strap and maintaining the strap taut substantially along the entire length of the flow path and further thereby forcing the strap from its path of travel to its binding engagement to the article.

17. A method as in claim 15 further comprising connecting the leading length of the strap onto itself by heat sealing and subsequently separating the leading length from the remainder by severing.

18. A method as in claim 15 further comprising regripping a subsequently formed free end of the strap resulting from separating the leading length and the remainder of the strap for completing another binding cycle therewith.

19. A method as in claim 15 further comprising tensioning the strap by continuously applying a weighted force thereto along a length of the flow path between the stretching and the gripping of the strap.

20. An method as in claim 15 further comprising shaping the film from the sheet configuration into the strap prior to stretching the strap and subsequently stretching the strap to a length less than its maximum length dependent on the predetermined parameters of tension strength of the stretchable material.

* * * * *